United States Patent [19]

Skinner

[11] 4,105,124

[45] Aug. 8, 1978

[54] INCLINED CONVEYOR BELT SOLIDS SEPARATING SYSTEM WITH RESPONSIVE GAS CONTROL

[75] Inventor: James L. Skinner, Richardson, Tex.

[73] Assignee: Atlantic Richfield Company, Los Angeles, Calif.

[21] Appl. No.: 749,588

[22] Filed: Dec. 10, 1976

[51] Int. Cl.[2] ..... B07C 1/00

[52] U.S. Cl. ..... 209/114

[58] Field of Search ..... 209/114, 117

[56] References Cited

U.S. PATENT DOCUMENTS

| | | | |
|---|---|---|---|
| 661,802 | 11/1900 | Hilleary, Jr. | 209/114 |
| 1,140,236 | 5/1915 | Aynes | 209/117 |
| 1,404,363 | 1/1922 | Grimsrud et al. | 209/114 |
| 2,318,976 | 5/1943 | Stevens | 209/114 |

*Primary Examiner*—Allen N. Knowles

*Attorney, Agent, or Firm*—M. David Folzenlogen

[57] ABSTRACT

A conveyor belt is inclined from horizontal along its longitudinal axis at a preselected angle and is used to separate spherically-shaped rolling solids from irregularly-shaped nonrolling solids. The spherically-shaped solids roll down the inclined upper surface of the conveyor belt until they are removed from the belt. At a preselected area on the belt, the downward movement of the rolling solids is controlled by jets of gas blown up the belt. The force of the jets of gas may be quickly varied to hold the proper amount of spherically-shaped solids on the belt and also prevent the belt from being flooded by a mixture of unseparated solids. This responsive gas control facilitates separation and upward movement of the nonrolling solids. Most of the nonrolling solids eventually move to an upper point on the belt where they are removed. The upward movement of the irregularly-shaped nonrolling solids is preferably controlled in a way which facilitates the freeing of rolling solids trapped by the upward movement of the nonrolling solids. The momentum and direction of the solids being fed onto the belt may also be adjusted to further control and increase the separating efficiency of the system.

25 Claims, 2 Drawing Figures

INCLINED CONVEYOR BELT SOLIDS SEPARATING SYSTEM WITH RESPONSIVE GAS CONTROL

BACKGROUND OF THE INVENTION

This invention pertains to inclined conveyor belt separating systems with a responsive, lower gas control arrangement. The separating systems are for separating spherically shaped rolling solids from irregularly-shaped nonrolling solids and are especially useful for oil shale retorting processes using spherically-shaped solid heat carriers which are recycled through the retorting process.

It is sometimes necessary, e.g., oil shale retorting with spherical heat carriers, to separate spherically-shaped rolling solids from irregularly-shaped rolling solids. The spherically-shaped solids are recovered while the irregularly-shaped solids are separated for disposal. There are many systems for separating solids which have significantly different sizes or particle weights, but there are relatively few ways of efficiently separating a large volume of solids having similar sizes and particle weights, especially when a dry, compact, high capacity, flexible separating system is required.

Copending application Ser. No. 749,505, filed Dec. 10, 1976, which is entitled "Separation and Recovery of Heat Carriers in an Oil Shale Retorting Process", and Ser. No. 749,587, filed Dec. 10, 1976, which is entitled "Inclined Conveyor Belt Solids Separation System", and which are owned by a common assignee and are incorporated herein, provide embodiments of elongated conveyor belt solids separating systems wherein the conveyor belt is appropriately inclined from horizontal along its longitudinal axis. Application Ser. No. 749,587 describes, among other things, upper and lower solids control arrangements and solids feed control measures.

The longitudinally inclined conveyor belt separating system requires smooth, continuous operation. It requires that a proper amount of spherically-shaped solids be maintained on the upper surface of the conveyor belt. Yet, in some cases, the mass flow rate of the solid, or the relative concentrations of the solids, or other conditions or combinations thereof, are likely to fluctuate on both a sporadic and a longer cyclic basis. These changes adversely affect the separating efficiency of the separating system or cause inefficient overdesign allowances. These fluctuations tend to create rapid channeling of rolling solids off the belt or waves of piled-up unseparated solids which pass up the surface of the belt and tend to flood the belt. When channeling occurs, unseparated nonrolling solids are carried off with the rolling solids. When flooding occurs and channeling is not used as a counteractive measure, spherically-shaped solids are carried over with the less valuable, irregularly-shaped solids.

This invention describes a responsive, easy to operate inclined conveyor belt separating system for maintaining the proper amount of spherically-shaped rolling solids on the conveyor belt while preventing channeling of the rolling solids off the belt and flooding of the belt by unseparated solids. Some enbodiments of this invention utilize some of the control measures described in the aforementioned application Ser. No. 749,587.

SUMMARY OF THE INVENTION

The upper surface of a longitudinally inclined moving conveyor belt provides the basic medium on which solids are separated according to roll characteristics. The upper surface moves upward and provides a continuously restored moving surface for separation of a mixture of spherically-shaped rolling solids and irregularly-shaped nonrolling solids fed onto the belt at a preselected feed point. The upper surface of the belt is inclined from horizontal along its longitudinal axis at an angle which is at least as great as the static roll angle of the spherically-shaped rolling solids and less than the static slide angle of the irregularly-shaped, nonrolling solids.

On the belt, most of the nonrolling solids eventually move up the belt while most of the rolling solids roll down the belt. At preselected points above and below the feed point, the movement of the solids is controlled in ways which cooperate with each other and other features of the separating system to provide an adjustable, balanced, smoothly operating, efficient separating system which is rapidly responsive to fluctuating operating conditions.

The lower control emits jets of gas over the width of the belt which retard the rate of downward movement of the spherically-shaped and trapped irregularly-shaped solids and which maintain the proper amount of rolling solids on the belt. The slowing of the rate of downward rolling movement of the spherically-shaped solids allows trapped or bridged irregularly-shaped solids to come to rest and move back up with the belt. It is desired that at least two side-by-side rows of spherically-shaped solids be maintained at a preselected lower area on the belt and that the amount of spherically-shaped solids held on the belt be less than the amount that would impair the effectiveness of the separating surface area of the belt, that is, below the amount which would cause flooding of the belt. The force of the jets of gas may be rapidly and automatically fluctuated to maintain the proper balance between the rate of arrival and accumulation of solids and the amount of solids needed to allow the trapped nonrolling solids to move up with the belt. The jets of gas have the further advantage of disrupting the interaction between the trapped irregularly-shaped solids and the downward rolling spherically-shaped solids. In other words, the jets of gas loosen the pack of solids and make it easier for the irregularly-shaped solids to work back up the belt as the belt is rotated or moved about its ends.

At a preselected area above the feed point, the upward movement of the now rolling solids may be slowed and the nonrolling solids moved in a sideways, upward direction or directions to a side of the conveyor belt where the non-rolling solids are removed or fall from the belt. To reduce channeling, a portion of nonrolling solids may be deflected upward and sideways toward the center of the belt until they are moved sideways toward the side of the belt.

The initial trapping and channeling tendency of the solids is reduced by controlling the impact momentum and initial tendency of the solids to move in a predetermined direction on the belt. The conveyor belt may also be inclined from horizontal by an angle which is at least as great as the static slide angle of a spherically-shaped rolling solid.

DETAILED DESCRIPTION

Figure 1:
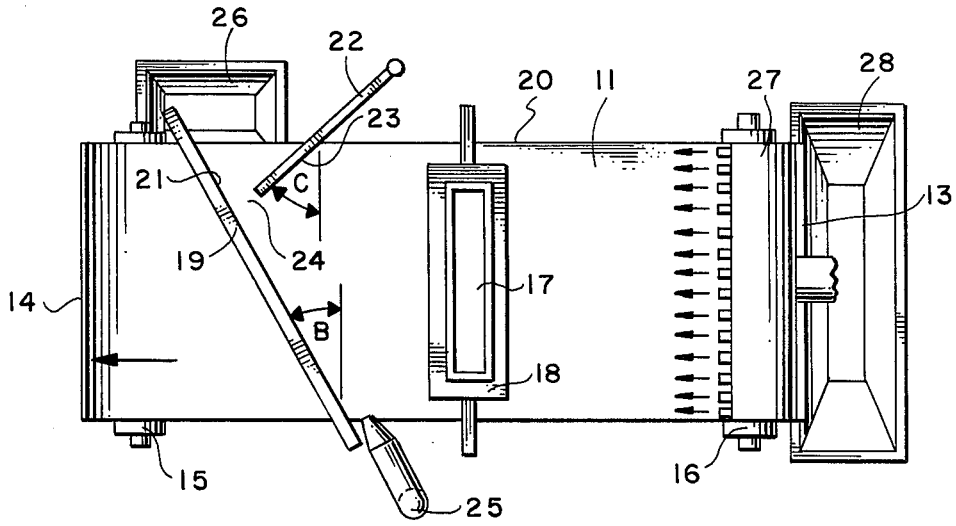
FIG. 1 is a top plan view of a moving inclined conveyor belt separating system.
Figure 2:
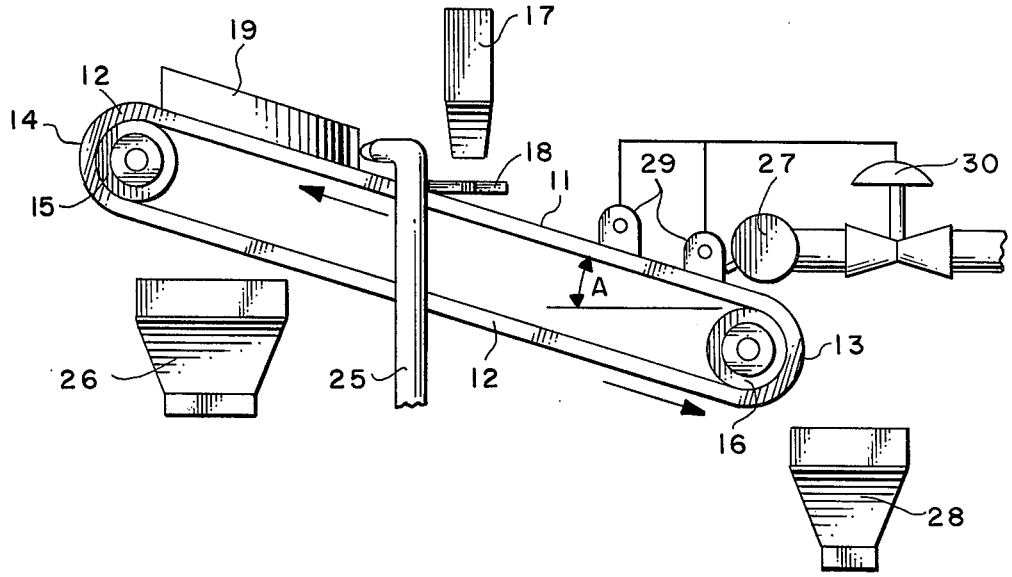
FIG. 2 is a side view of FIG. 1 with valve controller and sensors added.

An inclined conveyor belt solids separating system is illustrated in FIGS. 1 and 2. Inclined upper surface 11 of conveyor belt-like member 12 is the basic medium used for separating spherically-shaped rolling type solids from irregularly-shaped nonrolling type solids. The spherically-shaped solids are sufficiently round to roll down inclined upper surface 11. Generally, it is preferred that the rolling solids have a sphericity factor of at least 0.9. The sphericity factor is the external or geometric surface area of a sphere having the same volume as the spherically-shaped solid divided by the external surface area of the spherically-shaped solid. The nonrolling solids are sufficiently irregularly-shaped, laminar-like, flat, or rough, that one or more of their sides causes the irregularly-shaped solid not to roll down the inclined upper surface of the conveyor belt. Instead, the irregularly-shaped solid will tend to come to rest on the inclined surface. For purposes of this description, it is assumed that the relative concentration of spherical solids is substantially greater than the concentration of irregularly-shaped solids.

The upper surface of the conveyor belt-like member is inclined from horizontal along its longitudinal axis at angle A which is at least as great as the static roll angle of the desired size spherically-shaped solids and is less than the static slide angle of the equal size irregularly-shaped solids. The static roll angle of the spherically-shaped solids is determined by holding an approximately median size, rolling solid at rest on the upper surface of the conveyor belt at a point on the upper surface where the mixture of solids is to be fed onto or initially contact the belt and releasing such rolling solid to determine the minimum angle of the upper surface at which the released solid will roll down the upper surface. The static slide angle of the irregularly-shaped solids is determined by holding a nonrolling solid having a size approximately equal to the median size rolling solid at rest on a flat or rough side of the nonrolling solid against the upper surface and releasing the irregularly-shaped solid to determine the minimum angle for the upper surface at which such released solid will slide down the upper surface. In one embodiment of this invention, the angle is at least as great as the static slide angle of the spherically-shaped solids. The static slide angle of spherically-shaped solids is determined by connecting the centers of three median size rolling solids together in an equilateral triangular arrangement with a solid particle at each corner of the triangle. In this manner, there will be three connected spherically-shaped solids tangentially touching the conveyor at only three points. Thereafter, the angle of the belt is adjusted until the minimum angle at which the static connected solids will start to slide and continue to slide down the surface is determined. The static slide angle of the spherically-shaped solids is less than the static slide angle of the irregularly-shaped solids. These angles inherently take into consideration the smoothness of the belt and the interaction between the surface of the solids and the surface of the belt. Generally, it is desirable to test a representative number of such solids and a representative number of the different size solids of both types. The tests will be conducted with the belt not moving and will usually be conducted at normal room temperature, that is, 24° C (75° F). When the operating temperature is expected to significantly affect the rolling or sliding charcteristics of the solids, it is best to determine these static angles at the expected operating temperatures. For example, in an oil shale retorting process, the spherically-shaped solids may bear a combustible organic residue which affect the rolling characteristics of these solids at elevated temperatures.

As inclined, the conveyor belt-like member has lower end 13 and upper end 14. The belt is adapted in the usual fashion of a conveyor belt to rotate about lower end roller 15 and upper end roller 16 so that inclined upper surface 11 moves upward from lower end 13 to upper end 14. This movement continuously restores upper surface 11. The speed of the belt will be adjustable to suit the other operating conditions of the separating system. The belt is tight, uniform, relatively smooth, and made of material that is sufficiently temperature resistant.

At an appropriate preselected point above lower end 13, supply means 17 is adapted to feed a mixture of spherically-shpaed solids and irregularly-shaped solids onto an initial impingement portion of inclined upper surface 11. The supply means is any sort of system, e.g., one or more chutes or passages, for feeding a mixture of solids to a surface. The feed mixture has a preponderance of spherically-shaped solids. On the separating surface, the spherically-shaped solids move faster and easier than the irregularly-shaped solids. The solids in the feed mixture have an initial momentum and direction of movement which normally tends to trap irregularly-shaped solids with the spherically-shaped solids. These tendencies may be reduced by adapting the supply means to reduce the impact momentum of the solids on inclined upper surface 11 and by further adapting the supply means to control the initial tendency of the solids to move in a predetermined direction on inclined upper surface 11. The predetermined direction will depend on the angle of inclination of the conveyor belt, the rate of movement of the inclined upper surface, the solids feed rate, the relative concentrations of the solids, and the solids saturation on inclined upper surface 11. The objective is to minimize the trapping of the nonrolling solids and to increase the effective surface area and separating efficiency of the system. As illustrated, the supply means has pivotal deflector plate 18 which slows the rate of movement of the solids just prior to their impacting inclined upper surface 11 of the conveyor belt. The deflector plate is pivoted to provide the proper angle and direction of feed of the mixture of solids to at least partially control the initial tendency of the impacting solids to move in the desired direction.

When a mixture of the two groups of solids is fed onto the inclined upper surface of the conveyor belt, it is intended that most of the spherically-shaped rolling solids will roll down the inclined upper surface and will be removed at a preselected lower area below the feed point or initial impingement area of the solids. It is also intended that most of the irregularly-shaped solids will eventually come to rest on the belt and will move up with the belt and be removed at a preselected upper area above the feed point or initial impingement area of the solids. The irregularly-shaped nonrolling solids will be removed by simply allowing them to fall off upper end 14 of the conveyor belt-like member, but it is much preferred that they be removed in a controlled manner which tends to release spherically-shaped solids unintentionally moving up with the belt. Upper removal means 19 is adapted to deflect or move irregularly-shaped nonrolling solids moving upward on inclined upper surface 11 in an upward, sideways direction so that the nonrolling solids move off side 20 of the conveyor belt. Upper removal means 19 may be any sort of system, for example, a scraper, brush, or gas jet, for cooperating with movement of the belt and for deflecting nonrolling solids off the belt. As shown, upper removal means 19 is a scraper blade which has lower side 21 which diagonally crosses inclined upper surface 11 at angle B with respect to the width of the belt so that lower side 21 slopes upward and sideways with respect to the longitudinal axis of the belt. The lower edge of the blade is parallel to and fits flat on inclined upper surface 11. The angle B is appropriately selected to slow and control the rate of upward and sideways movement of the irregularly-shaped solids toward the side of the belt. The slowing and changing of the direction of movement of the nonrolling solids tends to free trapped rolling solids and reduce solids channeling off the belt, thereby increasing the separation efficiency of the system and reducing loss or carry-over of spherically-shaped solids.

The effectiveness of upper removal means 19 is affected by several operating conditions of the separating system especially the degree of solids saturation on the belt. At both high and low saturations, it is best to provide for additional control over the nonrolling solids. Sidee control means 22 is adapted to coact with upper removal means 19 and control the rate of movement of the irregularly-shaped solids deflected toward and off side 20 by the scraper. Side control means 22 is also adapted to deflect a portion of the irregularly-shaped solids moving upward on inclined upper surface 11 in an upward, sideways direction away from side 20 of the conveyor belt and toward lower side 21 of upper removal means 19. As shown, side control means 22 is a scraper blade which has inner side 23. The side control scraper is pivotally and adjustably mounted to control opening 24 between lower side 21 of upper removal means 19 and the end of the side control means and to change angle C with respect to the width or lateral axis of the belt. This side control means could be operated manually or automatically and appropriate sensors could be provided for detecting rate of solids movement, saturation and build up near upper removal means 19.

If conditions warrant, auxiliary side control means 25 could be provided. The auxiliary control means would be adapted to increase the rate of movement of the irregularly-shaped solids through opening 24 and off side 20 of the conveyor belt-like member. The auxiliary control means could be any sort of system for accelerating or pushing solids through the opening. As shown, the control means is an appropriately aimed gas jet which could be controlled manually or automatically by appropriate sensors in the same way that side control means 22 is controlled. As previously mentioned, for purposes of this description, it is assumed that the relative concentration of nonrolling solids is substantially less than the concentration of rolling solids in the mixture of solids to be separated and the auxiliary control means will not usually be needed.

Adjacent the preselected upper removal area is first receiving means 26 which is adapted to receive irregularly-shaped solids leaving inclined upper surface 11. This receiving means is any sort of system, e.g., one or more troughs, catchers or chutes, for receiving and collecting the nonrolling solids.

At a preselected lower area on inclined upper surface 11 below the feed area of the solids, lower control means 27 is located and adapted to emit jets of an appropriate type gas over the width of the conveyor belt which retard the rate of rolling of the spherically-shaped solids moving down and off the conveyor belt-like member. The gas will be inert to the solids and noncombustion supporting if there are combustible materials present.

At an appropriate point below lower control means 27, there is second receiving means 28 adapted to receive spherically-shaped solids rolling off the conveyor belt-like member. Second receiving means is shown as a trough positioned below lower end 13. This receiving means could be any sort of system for receiving and collecting solids.

For illustrative purposes, lower control means 27 is shown as a cylindrical manifold running across the width of inclined upper surface 11 and located vertically in such a manner that numerous jets of gas are emitted through a row or rows of blow holes or nozzles in the manifold and directed up inclined surface 11. The force and direction of these jets impinges on solids (predominantly spherically-shaped solids) passing through the preselected lower area thereby retarding downward movement of these solids and also tending to loosen the pack of solids in this area. This retardation controls rapid channeling of the spherically-shaped solids off inclined upper surface 11 and increases the release of bridged or trapped irregularly-shaped solids so that they may come to rest on inclined upper surface 11 and move up with the belt to the preselected upper removal area previously described. This significantly increases the separation efficiency of the system since a large portion of the nonrolling solids are likely to be trapped by the faster moving, greater number of spherically-shaped rolling solids.

The effects of the jets of gas of lower control means 27 are markedly increased if the force, number, and location of the jets is adapted to maintain at least two side-by-side rows of spherically-shaped solids at the preselected lower area on the inclined upper surface below the initial impingement portion of the upper surface and above lower end 13. This practically assures that the irregularly-shaped nonrolling solids will come to rest on inclined upper surface 11 and move up with the belt.

But the preventing of rapid channeling of rolling solids off the belt and the holding of two or more side-by-side rows of spherically-shaped solids on inclined upper surface 11 increases the chances that the desired balance between the rate of arrival of solids to the preselected lower control area and the rate of exit of solids from the area will not be maintained, especially when sporadic or cyclic changes in operating conditions occur. If the balance is not maintained, either insufficient solids will be held on the upper surface or too many solids will be held on the upper surface. If this latter event occurs, a wave of unseparated, piled-up solids backs up the inclined surface thereby flooding or over saturating the effective separating surface area of the belt between the initial impingement portion of the inclined upper surface and the preselected lower control area. The jets of gas of lower control means 27 provide a highly responsive system for reacting to variations in operating conditions. The force of the jets of gas may be adapted to fluctuate in a manner such that at least two side-by-side rows of spherically-shaped solids are maintained in the preselected lower control area on inclined upper surface 11 and in a manner such that the effectiveness of the separating surface area between the initial impingement portion or area and the preselected lower control area or rows of spherically-shaped solids is maintained. In other words, flooding or over saturation of this intermediate separating area will be prevented.

The jets of gas of lower control means 27 could be controlled manually or automatically. Automatic control by way of illustrative sensors 29 and control valve 30 is much preferred. The sensors will optically or otherwise detect rate of solids movement, saturation, and build up at appropriate points above and at the preselected lower control area and transmit appropriate signals causing control valve 30 to respond in the desired manner to lengthen or shorten the number of rows of solids on the belt in the preselected lower control area.

During operation, elongated inclined upper surface 11, inclined at the angle previously mentioned, is moved around lower end 13 at a lower elevation past a feet point under supply means 17 to a higher elevation around upper end 14 of the conveyor belt. This movement provides a continuously restored impingement area for receipt of solids. The impingement area will be clear of solids except for previously trapped solids moving up or down on the belt after being freed or released from the other solids.

A mixture of spherically-shaped solids and irregularly-shaped solids is fed from supply means 17 onto an intial impingement portion or area of inclined upper surface 11. The rate of movement of the solids being fed onto the inclined surface of the belt may be slowed just prior to impact with the surface, thereby reducing the impact momentum that the solids would have had had they not been slowed. Moreover, the direction of movement of the solids may be adjusted by deflector plate 18 to control the initial tendency of the solids to move up or down the conveyor belt or to essentially have no initial tendency to move in either direction. Reducing impact momentum and controlling initial movement of the solids will increase the separating efficiency and reduce the trapping of solids of the other class.

The angle of inclination of the belt and the rate of feed of the mixture of solids maintain a monolayer of spherically-shaped solids on inclined upper surface 11. The word "monolayer" refers to a single layer of rolling solids with respect to vertical or an axis perpendicular to inclined upper surface 11. In other words, the solids do not stack one on top of the other. A monolayer is desired for proper operation of the inclined conveyor belt separating system. A relatively large percentage of the irregularly-shaped solids is likely to be trapped by the spherically-shaped solids and move down the belt until the rate of downward movement of the solids is decreased or the irregularly-shaped solids come to rest. In order that these nonrolling solids may move back up with the belt, the irregularly-shaped solids must grab inclined upper surface 11. If the solids were not maintained in a monolayer either by the angle of inclination of the belt and the rate of feed, or by the loosening effect of the jets of gas, the irregularly-shaped solids could not grab the inclined upper surface of the conveyor belt.

Most of the irregularly-shaped solids fed onto the inclined upper surface eventually moved in a generally longitudinal direction up with the inclined upper surface to an upper removal point or area at an elevation higher on the conveyor belt than the initial impingement area. At this point, the irregularly-shaped solids are removed from the inclined upper surface of the conveyor belt. Preferably, at the upper removal point or area, the direction of upward movement of the irregularly-shaped solids is changed by upper removal means 19 and these nonrolling solids are moved in an upward, sideways direction by lower side 21 of upper removal means 19 at angle B with respect to the longitudinal axis of the conveyor belt so that these irregularly-shaped solids are moved toward side 20 and off the conveyor belt. This lateral, upward movement allows trapped spherically-shaped solids to roll free and move down the belt, thereby reducing carry-over of the spherically-shaped rolling solids.

To control channeling and rate of movement of the irregularly-shaped off the conveyor belt, the direction of upward movement of a portion of the irregularly-shaped solids at the upper removal area or point is changed by side control means 22 and this portion of these solids is moved in an upward, sideways direction away from side 20 of the conveyor belt before this portion of the solids is moved upward and sideways by upper removal means 19.

Most of the spherically-shaped solids fed onto inclined upper surface 11 by supply means 17 are allowed to roll down the inclined upper surface to a preselected lower control area below the solids initial impingement area of the upper surface and above lower end 13 of the conveyor belt. At the preselected lower control area, jets of gas from lower control means 27 are blown over the width of the inclined upper surface and the rate of downward rolling of the spherically-shaped solids in this area is retarded or slowed until the spherically-shaped solids pass through the preselected lower control area. Thereafter, the rolling solids passing through this area are allowed to roll from the inclined upper surface. As shown in the drawings, these solids are allowed to roll off lower end 13 of the conveyor belt.

In some embodiments, the force of the jets of gas is fluctuated by suitable means, e.g., control valve 30, in a manner such that at least two side-by-side rows of the spherically-shaped solids are maintained at the preselected lower control area on inclined upper surface 11 below the initial impingement area of the solids and above lower end 13 of the conveyor belt, and in a further manner to maintain the effectiveness of the separating surface area of the inclined upper surface below the initial impingement area and above the rows of spherically-shaped solids held in the preselected lower control area by the jets of gas. In other words, the force, number, or coverage of the jets of gas is fluctuated to prevent flooding or over saturation of the lower part of the inclined upper surface by solids while maintaining enough solids on this portion of the belt to facilitate release of bridged or trapped nonrolling solids.

The volumes andd relative amounts and sizes of the solids in the mixture will affect the overall design of the separating system. The spherically-shaped solids are normally in a relatively narrow size range when compared to the irregularly-shaped solids. The inclined conveyor belt system is especially suited to spherically-shaped solids in having a size about 0.14 centimeter (0.055 inch). The separating system performs best when a significant portion or all of the larger size and smaller size irregularly-shaped solids, especially fine size solids, are removed prior to using the inclined conveyor belt separating system. Fortunately, it is usually relatively easy to separate and remove a significant portion of the irregularly-shaped or fine size undesired solids.

If there is an appreciable amount of irregularly-shaped solids which are larger than the spherically-shaped solids and the volumes to be handled justify it, it would be best to first process the mixture to separate at least a portion of the larger irregularly-shaped solids prior to using the inclined conveyor belt system. The larger size irregularly-shaped solids may be separated by screening. This initial screening or separation of the larger size solids is optional and this step may be delayed until after some of the smaller size irregularly-shaped solids are removed.

By the same token, if the amount of irregularly-shaped solids smaller than the spherically-shaped solids is sufficiently large to warrant it, it would be best to remove at least a portion of the finer irregularly-shaped solids prior to treating the mixture on the inclined upper surface. Fine size solids greatly affect rolling characteristics and tend to unduly adhere to the separating surface of the conveyor belt. A significant portion, especially fines, of the smaller size irregularly-shaped solids may be removed by screening or by a low velocity elutriating gas. If the system is to be operated at elevated temperatures, it will be desirable to heat the gas used in elutriation. The gas should be a noncombustion supporting gas if there are combustible materials present on the solids.

The separating system of this invention is particularly advantageous for separating spherically-shaped heat carriers from irregularly-shaped spent shale, especially porous pellet heat carriers in a size range of between 0.14 centimeter (0.055 inch) to approximately 1.27 centimeter (0.5 inch) of the type described in U.S. Pat. No. 3,844,929. In oil shale retorting, mined crushed oil shale is mixed with hot, heatcarrying spherically-shaped solids in a retort. The heat in the hot heat carriers pyrolyzes oil and gas vapors from the oil shale and produces a mixture of spherically-shaped solids and nonrolling spent shale. After retorting, the solids mixture is processed to recover the heat carriers for recycle through the retorting process and for separation and disposal of the spent shale. This separation and recovery of solids is usually accomplished in several stages. One of the separating stages will use the inclined conveyor belt system of this invention. As mentioned in copending application Ser. No. 749,505, the efficiency of this process will be increased if a portion of the irregularly-shaped spent shale solids larger than the heat carriers is removed and if a portion of the irregularly-shaped spent shale solids smaller than the heat carriers is removed prior to processing a mixture of the remaining solids on the inclined conveyor belt system of this invention.

The present invention has been described with particular reference to specific examples, but it will be apparent to those skilled in the art that various changes and modifications may be made thereto without departing from the spirit and scope of the claims of this invention. For example, there may be more than one set of jets or sections of jets which may be independently controlled for response to the operating conditions of the system.

The embodiments of the invention in which an exclusive property or privilege is claimed are defined as follows:

1. A system for separating spherically-shaped solids which tend to roll down an inclined surface from irregularly-shaped solids which tend to slide down an inclined surface comprising:

a. a conveyor belt-like member having an inclined upper surface, an upper end, and a lower end; said conveyor belt-like member being adapted to move said upper surface from said lower end to and around said upper end; said inclined upper surface of said conveyor belt-like member being inclined upward from said lower end and from horizontal along its longitudinal axis at an angle at least as great as the static roll angle of said spherically-shaped solids and less than the static slide angle of said irregularly-shaped solids;

b. supply means adapted to feed a mixture of said spherically-shaped solids and said irregularly-shaped solids onto an initial impingement portion of said inclined upper surface above said lower end;

c. first receiving means adapted to receive irregularly-shaped solids leaving said inclined upper surface at a point above said initial impingement portion of said inclined upper surface;

d. lower control means adapted and located to emit jets of gas which retard the rate of rolling of said spherically-shaped solids off said conveyor belt-like member; and e. second receiving means adapted to receive spherically-shaped solids rolling off said conveyor belt-like member.

2. The system of claim 1 wherein upper removal means is located above the initial impingement portion of the conveyor belt-like member, said removal means being adapted to deflect irregularly-shaped solids moving upward on the inclined upper surface in an upward, sideways direction so that said irregularly-shaped solids move off a side of said conveyor belt-like member.

3. The system of claim 2 wherein side control means is adapted to deflect a portion of said irregularly-shaped solids moving upward on said inclined upper surface in an upward, sideways direction away from the side of said conveyor belt-like member toward said upper removal means.

4. The system of claim 3 wherein the supply means is adapted to reduce the impact momentum of the spherically-shaped solids and the irregularly-shaped solids on said initial impingement portion of said inclined upper surface of said conveyor belt-like member.

5. The system of claim 3 wherein said inclined upper surface is inclined from horizontal along its longitudinal axis at an angle at least as great as the static slide angle of said spherically-shaped solids and is less than the static slide angle of said irregularly-shaped solids.

6. The system of claim 1 wherein the lower control means is adapted and located to emit jets of gas which retard the rate of rolling of the spherically-shaped solids off the conveyor belt-like member and maintain at least two rows of said spherically-shaped solids at a preselected point on the inclined upper surface below the initial impingement portion of said inclined upper surface and above the lower end of said conveyor belt-like member.

7. The system of claim 6 wherein upper removal means is located above the initial impingement portion of said conveyor belt-like member, said removal means being adapted to deflect irregularly-shaped solids moving upward on said inclined upper surface in an upward, sideways direction so that said irregularly-shaped solids move off a side of said conveyor belt-like member.

8. The system of claim 7 wherein said control means is adapted to deflect a portion of said irregularly-shaped solids moving upward on said inclined upper surface in an upward, sideways direction away from the side of said conveyor belt-like member toward said upper removal means.

9. The system of claim 8 wherein the supply means is adapted to reduce the impact momentum of the spherically-shaped solids and the irregularly-shaped solids on said initial impingement portion of said inclined upper surface of said conveyor belt-like member.

10. The system of claim 8 wherein said inclined upper surface is inclined from horizontal along its longitudinal axis at an angle at least as great as the static slide angle of said spherically-shaped solids and is less than the static slide angle of said irregularly-shaped solids.

11. The system of claim 1 wherein the lower control means is adapted and located to emit jets of gas which retard the rate of rolling of the spherically-shaped solids off the conveyor belt-like member and is adapted to fluctuate the force of said jets of gas in a manner such that at least two rows of said spherically-shaped solids are maintained at a preselected point on the inclined upper surface below the initial impingement portion of said inclined upper surface and above the lower end of said conveyor belt-like member and in a manner such that the effectiveness of the separating surface area of said inclined upper surface below said initial impingement area and above said rows of said spherically-shaped solids is maintained.

12. The system of claim 11 wherein upper removal means is located above said initial impingement portion of said conveyor belt-like member, said removal means being adapted to deflect irregularly-shaped solids moving upward on said inclined upper surface in an upward, sideways direction so that said irregularly-shaped solids move off a side of said conveyor belt-like member.

13. The system of claim 12 wherein side control means is adapted to deflect a portion of said irregularly-shaped solids moving upward on said inclined upper surface in an upward, sideways direction away from the side of said conveyor belt-like member toward said upper removal means.

14. The system of claim 13 wherein the supply means is adapted to reduce the impact momentum of the spherically-shaped solids and the irregularly-shaped solids on said initial impingement portion of said inclined upper surface of said conveyor belt-like member.

15. The system of claim 13 wherein said inclined upper surface is inclined from horizontal along its longitudinal axis at an angle at least as great as the static slide angle of said spherically-shaped solids and is less than the static slide angle of said irregularly-shaped solids.

16. A method for separating spherically-shaped solids which tend to roll down an inclined surface from irregularly-shaped solids which tend to slide down an inclined surface comprising:

a. moving an inclined upper surface of an elongated conveyor belt around a lower end of said conveyor belt at a lower elevation past a feed point to a higher elevation around an upper end of said conveyor belt, said inclined upper surface being inclined from horizontal along its longitudinal axis at an angle which is at least as great as the static roll angle of said spherically-shaped solids and being below the static slide angle of said irregularly-shaped solids;

b. feeding a mixture of spherically-shaped solids and irregularly-shaped solids at the feed point onto an initial impingement area of said doubly inclined upper surface, said impingement area being constantly restored as said inclined upper surface is moved around and from said lower end to and around said upper end;

c. moving most of said irregularly-shaped solids fed onto said inclined upper surface in a generally longitudinal direction up said inclined upper surface to an upper removal point at an elevation higher on said conveyor belt than said initial impingement area;

d. removing said irregularly-shaped solids from said inclined upper surface at said upper removal point;

e. allowing most of said spherically-shaped solids fed onto said inclined upper surface to roll down said inclined upper surface to a preselected area on said inclined upper surface below said initial impingement area and above said lower end of said conveyor belt;

f. blowing jets of gas directed at spherically-shaped solids located at said preselected area of said inclined upper surface and retarding the rate of rolling of said spherically-shaped solids located at said preselected area of said inclined upper surface; and g. allowing spherically-shaped solids passing through said preselected area of said inclined upper surface to roll from said inclined upper surface.

17. The method according to claim 16 wherein in step (c), the direction of upward movement of the irregularly-shaped solids at the upper removal point is changed and said irregularly-shaped solids are moved in an upward, sideways direction at an angle with respect to the longitudinal axis of the conveyor belt so that said irregularly-shaped solids move toward a side of said conveyor belt.

18. The method according to claim 17 wherein the direction of upward movement of a portion of said irregularly-shaped solids at said upper removal point is changed and said portion of said irregularly-shaped solids is moved in an upward, sideways direction away from the side of said conveyor belt before said portion of said irregularly-shaped solids is moved in an upward, sideways direction toward said side of said conveyor belt.

19. The method according to claim 18 wherein the rate of movement of the solids being fed onto said inclined upper surface in step (b) is slowed prior to impact with said inclined upper surface and the direction of movement of said solids is adjusted to control the initial tendency of said solids to move in a predetermined direction on said inclined upper surface of said conveyor belt.

20. The method according to claim 19 wherein the angle of inclination from horizontal of said conveyor belt is at least as great as the static slide angle of said spherically-shaped solids and is less than the static slide angle of said irregularly-shaped solids.

21. The method according to claim 16 wherein in step (f), the force of the jets of gas is fluctuated in a manner such that at least two rows of the spherically-shaped solids are maintained at a preselected point on the inclined upper surface below the initial impingement portion of said inclined upper surface and above the lower end of said conveyor belt and in a manner such that the effectiveness of the separating surface area of said inclined upper surface below said initial impingement area and above said rows of said spherically-shaped solids is maintained.

22. The method according to claim 21 wherein in step (c), the direction of upward movement of the irregularly-shaped solids at the upper removal point is changed and said irregularly-shaped solids are moved in an upward, sideways direction at an angle with respect to the longitudinal axis of said conveyor belt so that said irregularly-shaped solids move toward a side of said conveyor belt.

23. The method according to claim 22 wherein the direction of upward movement of a portion of said irregularly-shaped solids at said upper removal point is changed and said portion of said irregularly-shaped solids is moved in an upward, sideways direction away from the side of said conveyor belt before said portion of said irregularly-shaped solids is moved in an upward, sideways direction toward said side of said conveyor belt.

24. The method according to claim 23 wherein the rate of movement of the solids being fed onto said inclined upper surface in step (b) is slowed prior to impact with said inclined upper surface and the direction of movement of said solids is adjusted to control the initial tendency of said solids to move in a predetermined direction on said inclined upper surface of said conveyor belt.

25. The method according to claim 24 wherein the angle of inclination from horizontal of said conveyor belt is at least as great as the static slide angle of said spherically-shaped solids and is less than the static slide angle of said irregularly-shaped solids.

* * * * *

UNITED STATES PATENT OFFICE

CERTIFICATE OF CORRECTION

PATENT NO. : 4,105,124

DATED : August 8, 1978

INVENTOR(S) : James L. Skinner

It is certified that error appears in the above-identified patent and that said Letters Patent are hereby corrected as shown below:

In Column 10, line 66, "said" should read ---side---.

Signed and Sealed this

Sixth Day of March 1979

[SEAL]

*Attest:*

RUTH C. MASON
*Attesting Officer*

DONALD W. BANNER
*Commissioner of Patents and Trademarks*